US006155857A

United States Patent [19]

Kato et al.

[11] Patent Number: 6,155,857

[45] **Date of Patent: *Dec. 5, 2000**

[54] CONNECTOR AND AUTO-PARTS HAVING THE CONNECTOR ATTACHED THERETO

[75] Inventors: Shigeki Kato, Shiki; Toshihiko Shiratori; Hiroshi Sakamoto, both of Turugashimo, all of Japan

[73] Assignees: Honda Giken Kogyo Kabushiki Kaisha; Toyo Denso Kabushiki Kaisha, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,920

[22] Filed: Feb. 26, 1997

[30] Foreign Application Priority Data

Jul. 3, 1996 [JP] Japan ..... 8-79624

[51] Int. Cl.[7] ..... H01R 13/74

[52] U.S. Cl. ..... 439/248; 439/247

[58] Field of Search ..... 439/247, 248, 439/378

[56] References Cited

U.S. PATENT DOCUMENTS

| | | | |
|---|---|---|---|
| 4,647,130 | 3/1987 | Blair et al. | 439/248 OR |
| 4,909,748 | 3/1990 | Kozono et al. | 439/247 OR |
| 4,943,109 | 7/1990 | Skrbina et al. . | |
| 4,954,085 | 9/1990 | Inoue et al. | 439/248 X |
| 5,197,896 | 3/1993 | Landis et al. | 439/247 OR |
| 5,385,481 | 1/1995 | Kotyuk | 439/378 OR |
| 5,391,091 | 2/1995 | Nations | 439/378 OR |
| 5,622,511 | 4/1997 | Jarrett | 439/243 OR |

FOREIGN PATENT DOCUMENTS

| | | |
|---|---|---|
| 0 357 375 | 3/1990 | European Pat. Off. . |
| 0 539 863 | 5/1993 | European Pat. Off. . |
| 35 36 142 | 4/1987 | Germany . |

*Primary Examiner*—Paula Bradley
*Assistant Examiner*—Daniel Wittels
*Attorney, Agent, or Firm*—Armstrong, Westerman, Hattori, McLeland & Naughton

[57] ABSTRACT

A connector for making electrical connection between electrical terminals held in each of a female electrical terminal member and a male electrical terminal member of the connector by mechanically connecting both the female electrical terminal member and the male electrical terminal member. Both of the female electrical terminal member and the male electrical terminal member of the connector are attached to solid structures directly, instead of being attached to tip portions of flexible electric cables extended from outside of the solid structures. The solid structures are parts such as auto-parts or a partial assembly composed of a plurality of the parts or a body such as a body of an automobile which are to be assembled together and which have a larger size than the size of the connector. One of the male electrical terminal member and the female electrical terminal member of the connector includes at least one guide-pin protruding forwardly therefrom, whereas another includes at least one guide-hole for accepting and guiding the at least one guide-pin of thereinto. At least one of the male electrical terminal member and the female electrical terminal member of the connector is attached slightly movably to the solid structure.

7 Claims, 5 Drawing Sheets

1
10

3mm

3mm

3mm

3mm

CONNECTOR AND AUTO-PARTS HAVING THE CONNECTOR ATTACHED THERETO

BACKGROUND OF THE INVENTION

The present invention relates to a connector and auto-parts having the connector attached thereto, which are suitable for achieving automatic assembling of an automobile, and especially to a connector and auto-parts having the connector attached thereto, in which electrical connection is accomplished in the early stages of the mechanical connection between the auto-parts.

Assembling of an automobile is carried out by attaching various auto-parts to the body of the automobile in a predetermined order. In this case, it is more efficient to prepare some partial assemblies by assembling some auto-parts outside the body of the automobile (i.e., in open space) where such an assembling of the parts can be easily carried out. Then, such partial assemblies are finally assembled into the body of the automobile.

In the assembling method of using partial assemblies just described above, the amount of labor required of workers will be increased, because both the size and the weight of the partial assemblies will be increased when compared to the conventional method of automobile assembly in which smaller and lighter individual auto-parts are assembled into the body of the automobile one by one. Therefore, in the new assembly method that uses partial assemblies as described above, a robot assisted assembling system or a fully-automatic assembling system will be required.

Recently, more and more auto-parts are coming to have electronic parts therein. For those partial assemblies composed of auto-parts having electronic parts therein, it is necessary to make the electrical connections between the body of the partial assemblies and the body of the automobile, in addition to the mechanical connections between the bodies of the partial assemblies and the body of the automobile. In such situations, making the electrical connections between the bodies of the partial assemblies and the body of the automobile is becoming a more difficult problem than making the mechanical connections between the bodies of the partial assemblies and the body of the automobile, because of the structure of conventional connectors used.

Referring to FIG. 6, a typical prior art connector is shown. The typical prior art connector has a female electrical terminal member 20 and a male electrical terminal member 10. Both the female electrical terminal member 20 and the male electrical member 10 of the connector may be extended outside of the bodies of both the automobile and the partial assembly by electric cables 5, as shown. Both the female electrical terminal member 20 and the male electrical terminal member 10 of the connector are joined together to accomplish electrical connection, after mechanical connection between the body of the automobile and the body of the partial assembly has been accomplished.

Otherwise, as shown in FIG. 7, either one of the female electrical terminal member 20 or the male electrical terminal member 10 of a connector (in this case, the male electrical terminal member 10) is rigidly attached to either the body of the automobile or the body of the partial assembly, whereas the other member not previously connected (in this case, the female electrical terminal member 20) of the connector is extended from either the body of the automobile or the body of the partial assembly by electric cables 5, to accomplish electrical connection with the male electrical terminal member 10, after mechanical connection has been accomplished.

As described above, at least one of the female electrical terminal member 20 and the male electrical terminal member 10 of a connector is extended outside of the auto-parts or the body of the partial assembly or the body of the automobile by electric cables 5. Therefore, the location of at least one member of the connector which is attached to a tip portion of the flexible electric cables 5 becomes indefinite. As a result, making the electrical connection automatically between both the female electrical terminal member 20 and the male electrical terminal member 10 of the connector becomes a far more difficult problem than making the mechanical connection automatically between the auto-parts or the body of the partial assemblies or the body of the automobile, because of the indefiniteness of the location of at least one member of the connector. This makes it difficult to realize automatic assembly of an automobile.

SUMMARY OF THE INVENTION

Accordingly, it is an object of the present invention to provide a connector and auto-parts to which the a connector is connected, which are suitable for automatic assembly of an automobile.

These and other objects of the present invention may be achieved by a connector in which both of the female electrical terminal member and the male electrical terminal member are attached to solid structures directly, instead of being attached to the tip portions of flexible electric cables extended from outside from the solid structures. The solid structures include auto-parts or partial assemblies composed of assembled auto-parts or bodies of an automobile to be assembled together and have a larger size than the size of the connector.

According to an embodiment of a connector of the present invention, one member of the connector, either the male electrical terminal member or the female electrical terminal member, includes at least one guide-pin protruding forwardly therefrom, whereas the other member of the connector includes at least one guide-hole for accepting and guiding the at least one guide-pin thereinto.

BRIEF DESCRIPTION OF THE DRAWING FIGURES

FIGS. 5(A)–(E) are perspective views showing differing aspects of the male electrical terminal member centrally located and moving up, down, to the left and to the right.

Figure 6:
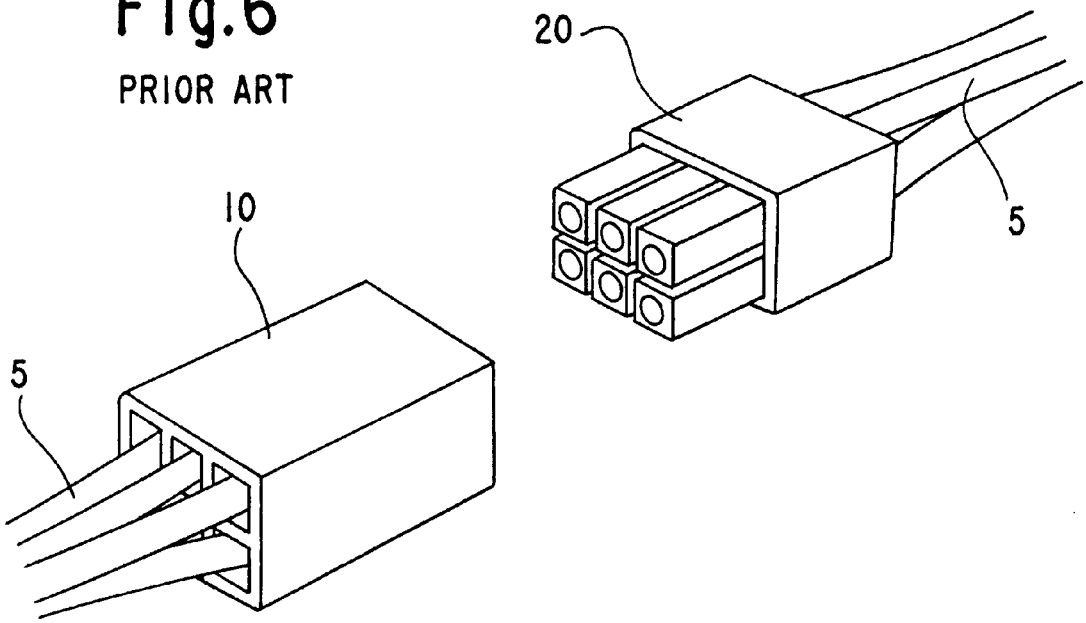
Fig.6 PRIOR ART

FIG. 6 is a perspective view showing an example of a prior art conventional connector.

Figure 7:
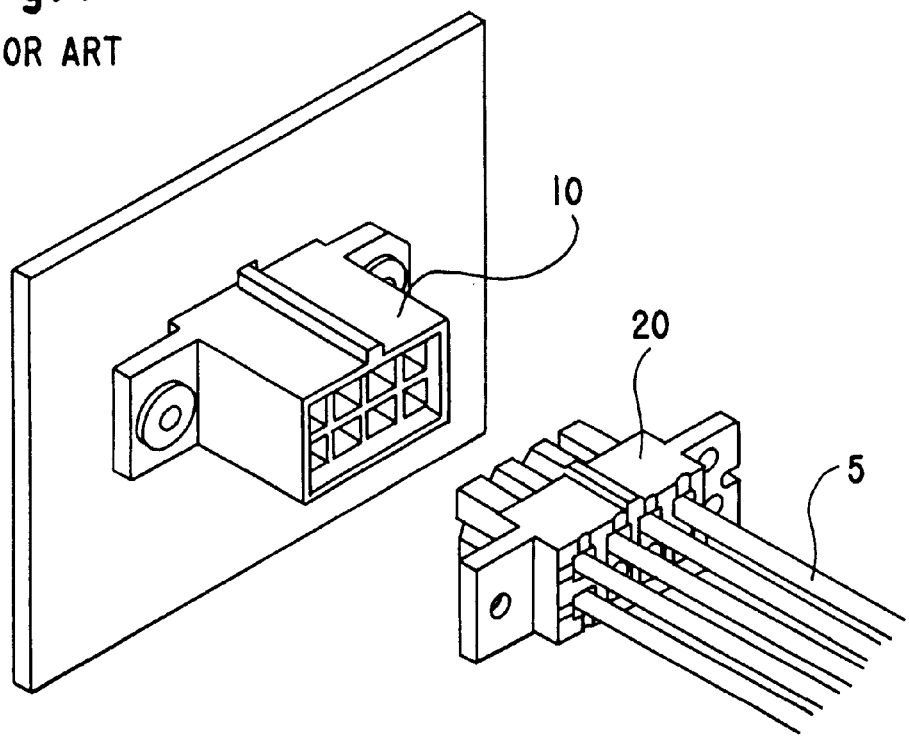
Fig.7 PRIOR ART

FIG. 7 is a perspective view showing another example of a prior art conventional connector.

DETAILED DESCRIPTION OF THE PREFERRED EMBODIMENT

Figure 1:
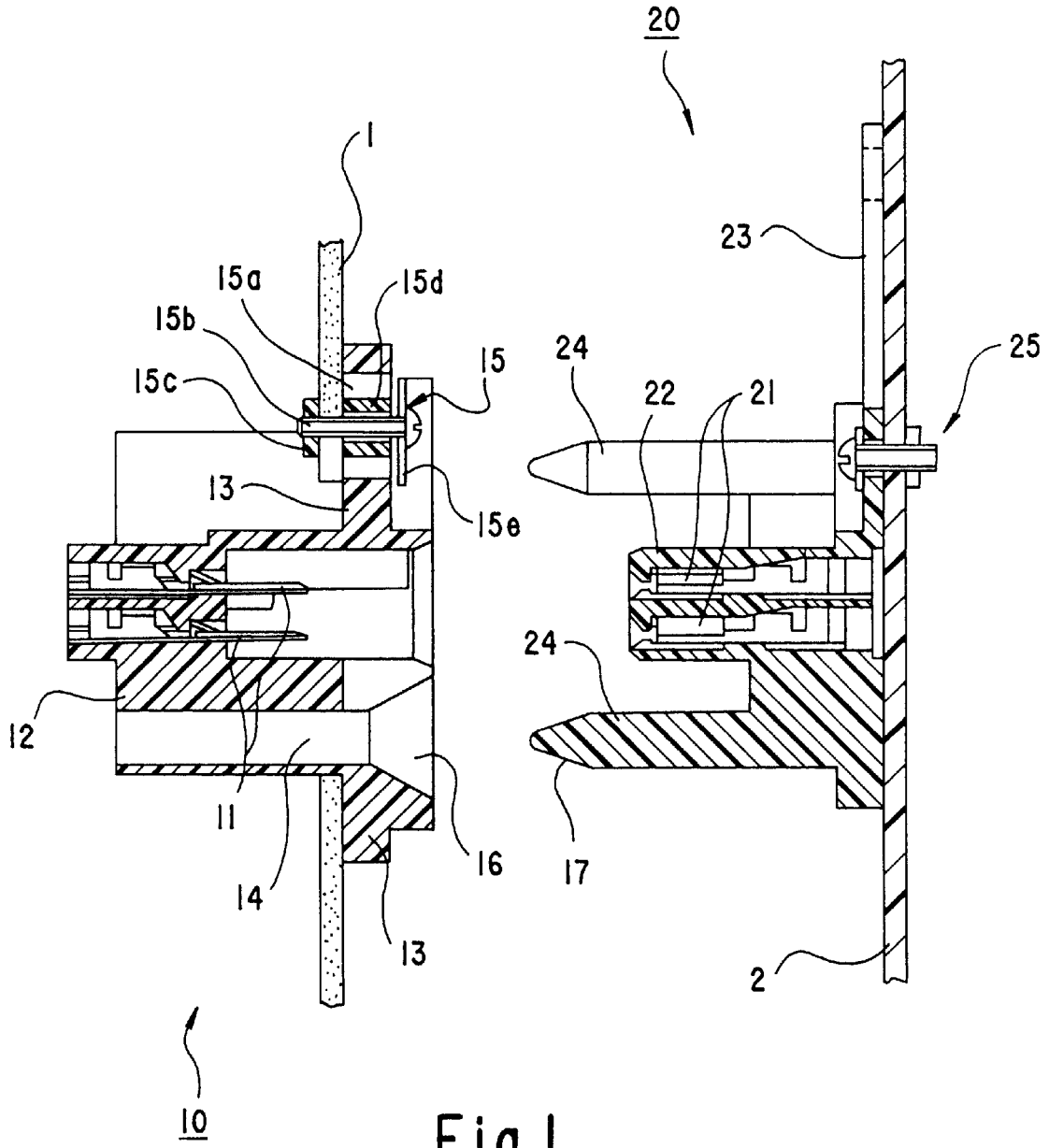
FIG. 1 is a sectional view showing the structure of a connector according to an embodiment of the present invention with an outer wall of a device (i.e., auto-parts) to be assembled together.
Figure 2:
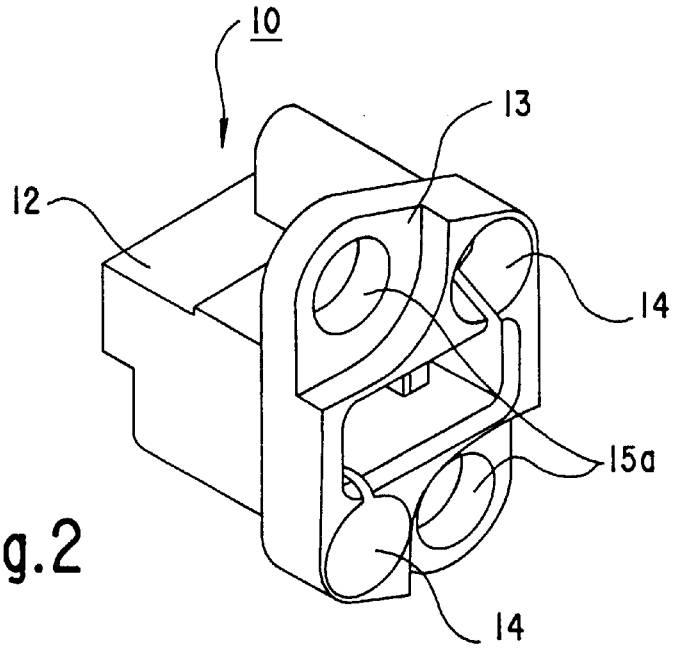
FIG. 2 is a perspective view showing the structure of a male electrical terminal member of the connector.
Figure 3:
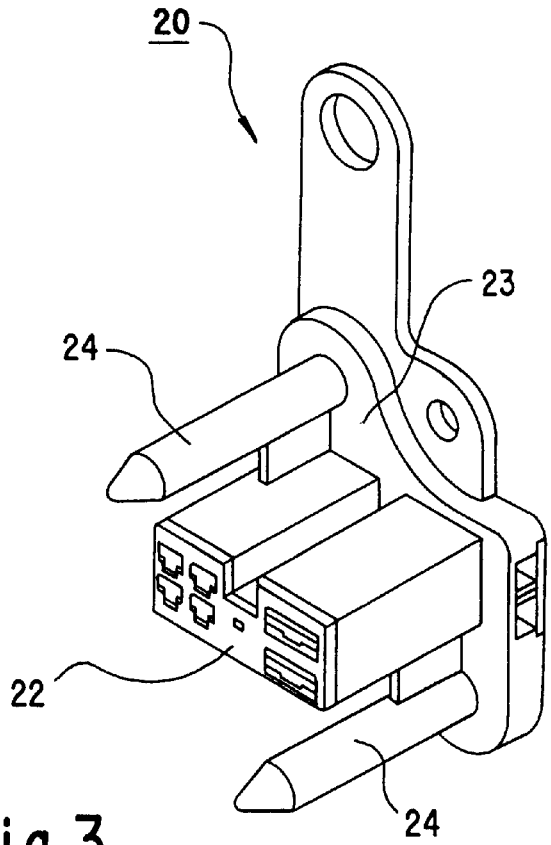
FIG. 3 is a perspective view showing the structure of a female electrical terminal member of the connector.
Figure 4:
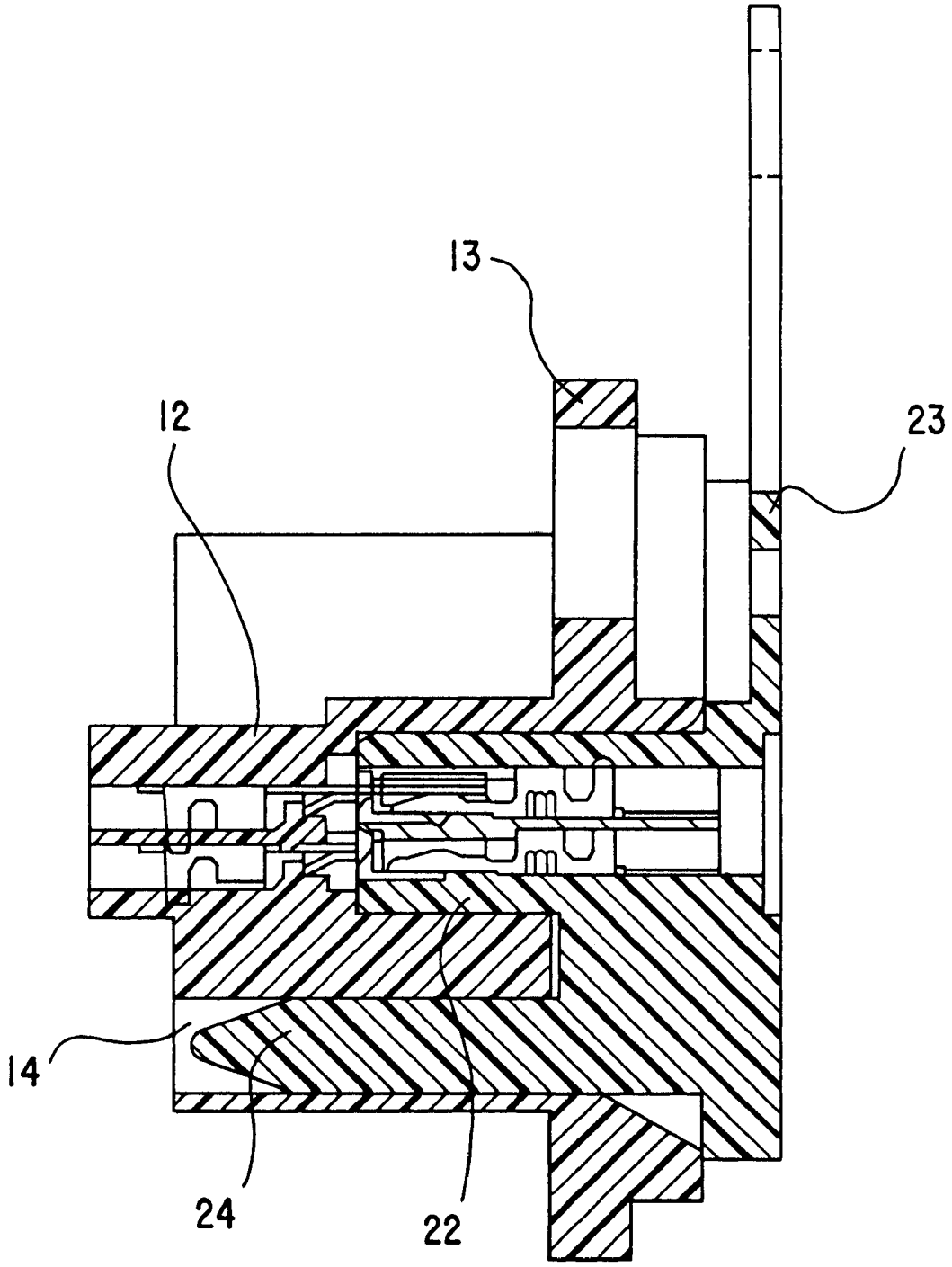
FIG. 4 is a sectional view showing the structure of the connector in which the male electrical terminal member and the female electrical terminal member are joined together.

FIG. 1 is a sectional view showing the structure of a connector according to an embodiment of the present invention with an outer wall of a device (i.e., auto-parts) to be assembled together. FIGS. 2 and 3 are perspective views of a male electrical terminal member 10 and a female electrical terminal member 20 of the connector, respectively. FIG. 4 is a sectional view showing the structure of the connector in which the male electrical terminal member 20 and the female electrical terminal member 10 are joined together.

Referring to FIG. 1, the male electrical terminal member 10 includes male electrical terminals 11, a housing 12 to house the male electrical terminals 11, a base plate 13, guide holes 14 and a slightly movable attaching mechanism 15. Electric wires (not shown in FIG. 1), which are extended from the electrical equipment held in the parts to which the male electrical terminal member 10 is to be attached, are connected to rear end portions of the male electrical terminals 11. Two guide-holes 14 are formed outside the housing 12, wherein each guide-hole 14 has a tip portion 16 with an inner diameter which gets wider toward the front end of the guide hole 14. The principal parts of the male electrical terminal member 10, including the housing 12, the base plate 13 and the guide-holes 14, are made as an indivisible unit by projection of resin.

The female electrical terminal member 20 includes female electrical terminals 21, a housing 22 to house the female electrical terminals 21, a base plate 23, guide-pins 24 and an attaching mechanism 25. Electric wires (not shown in FIG. 1), which are extended from electrical equipment held in the other parts to which the female electrical terminal member 20 is to be attached, are connected to rear end portions of the female electrical terminals 21. The guide-pins 24 protrude forwardly from the base plate 23 around the housing 22. The guide-pins 24 have tip portions 17 with outer diameters that become narrower towards the front ends of the guide-pins 24. The principal parts of the female electrical terminal member 20, including the housing 22, the base plate 23 and the guide-pins 24, are also made as an indivisible unit by projection of resin.

The male electrical terminal connector 10 is attached to the outer wall 1 of the device in a slightly movable manner by two slightly movable attaching mechanisms 15 (only one of the two such mechanisms is shown in FIG. 1). The slightly movable mechanism 15 includes through-holes 15*a* formed through the base plate 13, bolts 15*b* which are inserted through the through-holes 15*a*, nuts 15*c* which are threadingly engaged to the tip portions of the bolts 15*b* at the back side of the base plate 13, cylindrical collars 15*d* surrounding the bolts 15*b*, and washers 15*e* placed between the tip portions of the collars 15*d* and the neck portion of the bolts 15*b*.

The bolts 15*b* of the slightly movable attaching mechanism 15 are attached to the outer wall 1 in a slightly movable manner. To make narrow gaps between a surface of the base plate 13 and the washers 15*d*, the length of the collars 15*d* surrounding the bolts 15*b* is made slightly larger than the thickness of the base plate 13 of the male electrical terminal member 10. Further, the inner diameter of the through-holes 15*a* is made slightly larger than the outer diameter of the collars 15*e*, in this case by approximately 6 mm. As a result, the male electrical terminal member 10 of the connector is attached to the outer wall 1 in a manner so that it can slide along the surface of the outer wall 1 within a maximum range determined by the difference of the inner diameter of the through-holes 15*a* and the outer diameter of the collar 15*d* (in this case +/−6 mm).

Figures 5A, 5B, 5C, 5D, 5E:
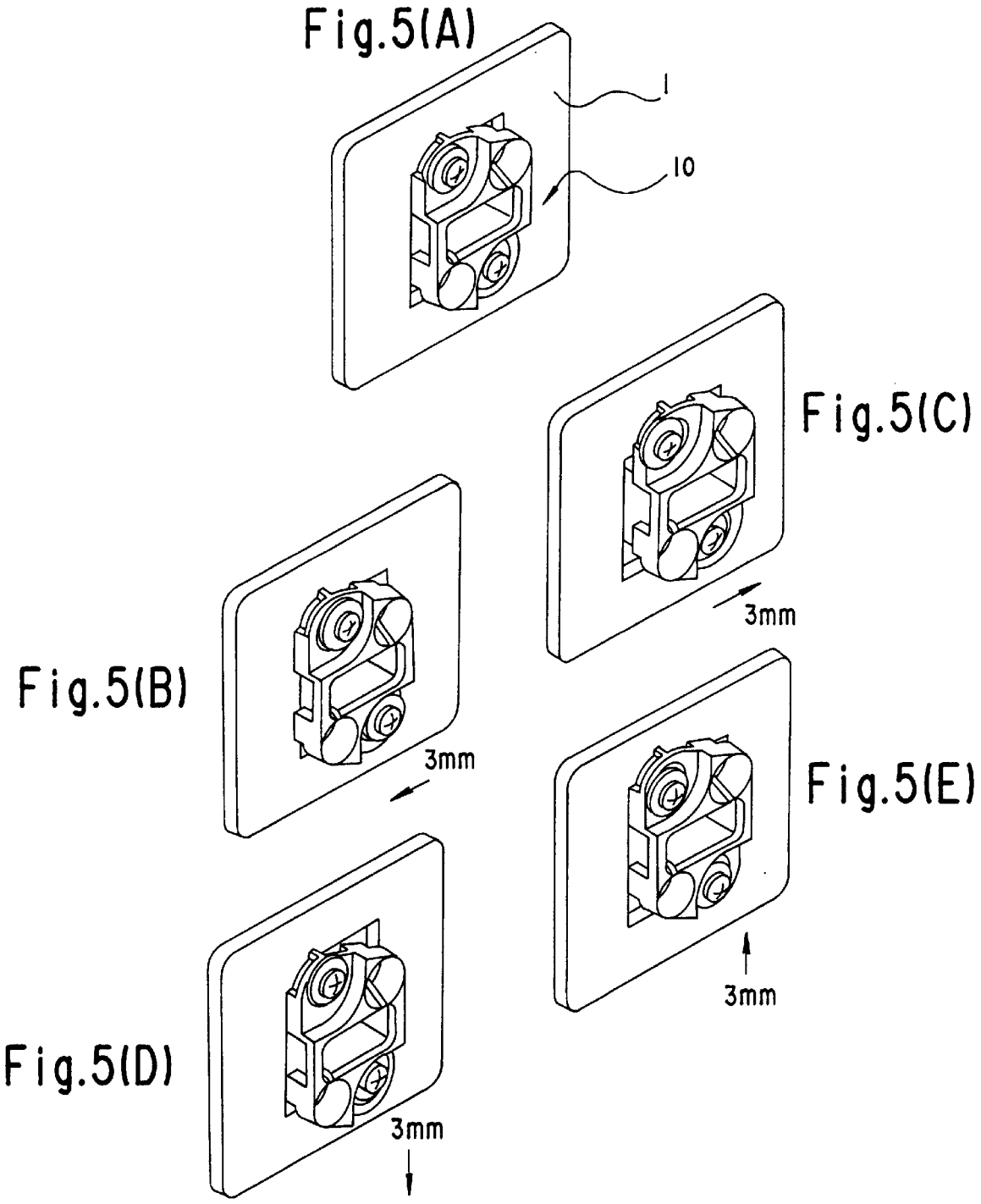

FIGS. 5(A)–(E) are perspective views showing aspects of the male electrical terminal member 10 moving up, down, to the left and to the right from the center position in each direction by 3 mm. FIG. 5(A) shows the male electrical terminal member 10 located in a central position. FIG. 5(B) shows the male electrical terminal member 10 moved to the left by 3 mm from the central position. FIG. 5(C) shows the male electrical terminal member 10 moved to the right by 3 mm from the central position. FIG. 5(D) shows the male electrical terminal member 10 moved downwards by 3 mm from the central position. FIG. 5(E) shows the male electrical terminal member 10 moved upwards by 3 mm from the central position.

In contrast, the female electrical terminal member 20 of the connector is attached to the outer wall 2 of the other parts by two conventional threadingly attaching mechanisms 25 composed of bolts, nuts and washers in order to keep the appropriate rigidness, although in FIG. 1, only one attaching mechanism 25 is shown.

Upon assembling of the parts or the partial assemblies or the body, each represented by only an outer wall 1 or 2 to which it is attached, the male electrical terminal member 10, which is attached to the outer wall 1 in a slightly movable manner, and the female electrical terminal member 20, which is attached to the outer wall 2, are moved closer to each other as the parts or the partial assemblies are moved closer to the body of the automobile by means of being held a robot arm or similar of an automatic assembling system. In the process of moving the parts to be assembled closer together, the male electrical terminal member 10 and the female electrical terminal member 20 of the connector work as an automatic positioning mechanism. When the male electrical terminal member 10 and the female electrical terminal member 20 are moved closer to each other, the tip portions 17 of the guide-pins 24, which are located in the most advanced position of the female electrical terminal member 20, contact the guide-holes 14 first, which are located in the most advanced position in the male electrical terminal member 10.

If positioning between the male electrical terminal member 10 and the female electrical terminal member 20 is ideal, the tip portions 17 of the guide-pins 24 will be inserted into the guide-holes 14 without contacting the inner walls of the guide-holes 14. However, the tip portions 17 of the guide-pins 24 will usually contact the inner walls of the guide-holes 14, because positioning between two members is not usually perfect. In this usual case, when both the female electrical terminal member 20 and the male electrical terminal member 10 are further moved closer together, a centering force for making the central axis of the guide-holes 14 coincide with the central axis of the guide-pins 24, is transmitted from the female electrical terminal member 20 to male electrical terminal member 10.

The male electrical terminal member 10 is forced to very slightly slide over the surface of the outer wall 1 due to the centering force to accept the female electrical terminal member 20 therein. Under so-called self-alignment by the centering force, a joining of the housings 12 and 22 will be completed to accomplish mechanical and electrical connection between the terminals 11 and 21. To realize the self-alignment mechanism described above, inner diameters of the tip portions 16 of the guide-holes 14 are made larger than the inner diameter of the guide-holes 14 or outer diameters of base portion of the guide-pins 24 by about 6 mm and the male electrical terminal member 10 is made slightly slidable over the surface of the outer wall 1 by at most +/−3 mm from the center position as described with respect of FIGS. 5(A)–(E) above.

After the mechanical and the electrical connection between the male electrical terminal member 10 and the female electrical terminal member 20 is accomplished, a final stronger mechanical connection is made between the parts or the partial assemblies or the body of the automobile, as represented by outer walls 1 and 2, using strong connecting facilities, such as a threadingly engageable mechanism (not shown in the Figures). In this final mechanical connection, positioning error and sizing error existing between the male electrical terminal member 10 and the female electrical terminal member 20 of the connector and parts or partial assemblies or the body of the automobile to be assembled together can be compensated for by the slight motion of the male electrical terminal member 10 by at most about +/−3 mm around the center position.

Although only one example is described in which the guide-pins 24 are provided to the female electrical terminal connector 20 and the guide-holes 14 are provided to the male electrical terminal connector 10, it is also possible to provide guide-pins 24 to the male electrical terminal member 10 and to provide guide-holes 14 to the female electrical terminal member 20.

Further an example is described in which only a male electrical terminal member 10 of a connector is attached to parts or similar to be assembled in a slightly movable manner. However, it is also possible to attach a female electrical terminal member 20 of a connector to parts or similar in such a manner, instead of the male electrical terminal member 10, or to attach both the male electrical terminal member 10 and the female electrical member 20 to the parts or similar in such a manner.

Furthermore, the slightly movable attaching mechanism 25 which compensates for the positioning errors and the sizing errors can be eliminated, in special cases in which the positioning errors and the sizing errors are negligibly small, because of the small size of the parts or similar to be assembled.

Also, an example is described in which a connector, according to the present invention, is attached to auto-parts. However, the connector of the present invention can be attached to other appropriate solid structures such as device, parts, and elements, as long as they have a larger size than the size of the connector.

As was described in detail, according to a connector of the present invention, locations of both the male electrical terminal member 10 and the female electrical terminal member 20 of the connector are made definite, because both members are directly attached to parts or similar with appropriate rigidness, instead of being attached to the tip portions of flexible electric cables 5, as was done in the prior art. As a result, the connector of the present invention makes it easy to realize an automatic assembly system for the auto-parts which include electronic parts.

According to a connector of the preferred embodiment of the present invention, self-alignment and compensation for positioning error and sizing errors can be accomplished, by providing guide-pins 24 and guide-holes 14 to one of the male electrical terminal member 10 and the female electrical terminal member 20, and by attaching at least one member to solid structures in a slightly movable manner.

What is claimed is:

1. A connector for making electrical connection between electrical terminals held in each of a female electrical terminal member and a male electrical terminal member of said connector by mechanically connecting both said female electrical terminal member and said male electrical terminal member, said connector comprising:

both of said female electrical terminal member and said male electrical terminal member of said connector being attached to solid structures directly, instead of being attached to tip portions of flexible electric cables extended outside of said solid structures, said solid structures composed of a plurality of parts or a body to be assembled together and having a larger size than a size of said connector;

wherein any one of said female electrical terminal member and said male electrical terminal member of said connector includes two guide pins protruding forwardly therefrom, whereas another includes two guide holes for accepting and guiding said two guide pins thereinto;

said two guide pins and two guide holes being positioned diagonally across each of the electrical terminal members so as to force the terminal members to perform a two dimensional self alignment; and at least one of said female electrical terminal member and said male electrical terminal member of said connector is slightly movably attached to one of said solid structures by bolts, each of said bolts being inserted in a cylindrical through hole of said solid structure and being surrounded by a cylindrical collar in said cylindrical through hole, a length of said cylindrical collar being slightly larger than a length of said cylindrical through hole and an outer diameter of said cylindrical collar being slightly smaller than an inner diameter of said cylindrical through hole.

2. A connector for making electrical connection between electrical terminals held in each of a female electrical terminal member and a male electrical terminal member of said connector by mechanically connecting both said female electrical terminal member and said male electrical terminal member, said connector comprising:

both of said female electrical terminal member and said male electrical terminal member of said connector being attached to solid structures directly, so as to enable both vertical and horizontal movement of at least one of said female electrical terminal member and said male terminal member relative to the other, instead of being attached to tip portions of flexible electric cables extended outside of said solid structures;

said solid structures being composed of a plurality of parts or a body to be assembled together and having a larger size than a size of said connector;

said parts being auto-parts and said body being a body of an automobile;

wherein at least one of said female electrical terminal member and said male electrical terminal member of said connector is slightly movably attached to one of said solid structures by bolts, each of said bolts being inserted in a cylindrical through hole of said solid structure and being surrounded by a cylindrical collar in said cylindrical through hole, a length of said cylindrical collar being slightly larger than a length of said cylindrical through hole and an outer diameter of said cylindrical collar being slightly smaller than an inner diameter of said cylindrical through hole.

3. An auto-part comprising:

a female electrical terminal member and a male electrical terminal member of a connector;

one of said female electrical terminal member or said male electrical terminal member attached to an auto part directly, so as to enable both vertical and horizontal movement of one to the other, instead of being attached to tip portions of electrical cables extended outside of said auto-part, by bolts, each of said bolts being inserted in a cylindrical through hole of said auto-part and being surrounded by a cylindrical collar in said cylindrical through hole, a length of said cylindrical collar being slightly larger than a length of said cylindrical through hole and an outer diameter of said cylindrical collar being slightly smaller than an inner diameter of said cylindrical through hole;

said male electrical terminal member and said female terminal member of said connector being connected mechanically and electrically when said auto-part, or a partial assembly composed of a plurality of said auto-parts are assembled into a body of an automobile or to said auto-part or to said partial assembly already assembled into said body of said automobile.

4. The auto-part as claimed in claim 3, wherein said connection of said male electrical terminal member and said female electrical terminal member of said connector is accomplished before final mechanical connection made in said assembly to said body of said automobile is accomplished.

5. The auto-part as claimed in claim 3, wherein any one of said female electrical terminal member and said male electrical terminal member of said connector is attached in a slightly movable manner to a solid structure.

6. The auto-part as claimed in claim 3, wherein one of said male electrical terminal member and said female electrical terminal member of said connector includes at least one guide-pin protruding forwardly therefrom, [whereas] and another includes at least one guide-hole for accepting and guiding said at least one guide-pin thereinto.

7. The auto-part as claimed in claim 6, wherein any one of said female electrical terminal member and said male electrical terminal member of said connector is attached in a slightly movable manner to a solid structure.

* * * * *